US007045765B2

(12) United States Patent
Auboussier et al.

(10) Patent No.: US 7,045,765 B2
(45) Date of Patent: May 16, 2006

(54) DEVICE FOR COUNTING STACKED PRODUCTS

(75) Inventors: Eric Auboussier, Saint Jean de Braye (FR); Benoît Berthe, La Chapelle Saint Mesmin (FR); Thomas Fumey, Orleans (FR)

(73) Assignee: Datacard Corporation, Minnetonka, MN (US)

( * ) Notice: Subject to any disclaimer, the term of this patent is extended or adjusted under 35 U.S.C. 154(b) by 293 days.

(21) Appl. No.: 10/464,867

(22) Filed: Jun. 19, 2003

(65) Prior Publication Data

US 2004/0217261 A1 Nov. 4, 2004

(30) Foreign Application Priority Data

Apr. 30, 2003 (FR) ..... 03 05353

(51) Int. Cl.
*H01J 40/14* (2006.01)
*G06M 9/00* (2006.01)

(52) U.S. Cl. ..... 250/222.1; 250/221; 250/208.1; 377/3; 377/8

(58) Field of Classification Search ..... 250/223 R, 250/221, 222.1, 559.47, 208.1; 377/3, 8; 273/149 R, 149 P, 309, 148 A; 463/22, 47
See application file for complete search history.

(56) References Cited

U.S. PATENT DOCUMENTS

| | | | | |
|---|---|---|---|---|
| 4,995,060 | A * | 2/1991 | Hill | 377/8 |
| 5,686,729 | A * | 11/1997 | Bittar et al. | 250/559.04 |
| 2004/0170314 | A1* | 9/2004 | Harris et al. | 382/151 |
| 2004/0178373 | A1* | 9/2004 | Graber et al. | 250/559.36 |

FOREIGN PATENT DOCUMENTS

| | | | |
|---|---|---|---|
| EP | 0 676 718 | A | 10/1995 |
| EP | 0 743 616 | A | 11/1996 |
| JP | 09-319853 | * | 12/1997 |

* cited by examiner

*Primary Examiner*—Thanh X. Luu
*Assistant Examiner*—Stephen Yam
(74) *Attorney, Agent, or Firm*—Miles & Stockbridge P.C.; Edward J. Kondracki

(57) ABSTRACT

The present invention relates to a device for counting thin products (1) that can be stacked side-by-side in a tray (2), characterized in that it comprises at least one counting station comprised of at least one CIS module ($\mathbf{3}_1$, $\mathbf{3}_2$, $\mathbf{3}_3$), whose overall length is at least equal to the length of the tray (2) and means for performing multiple scans in a direction transverse to the tray (2), each CIS module ($\mathbf{3}_1$, $\mathbf{3}_2$, $\mathbf{3}_3$) comprising at least means for longitudinally illuminating the products (1) and at least one CIS circuit comprised of a plurality of photosensitive elements connected to at least one printed circuit, the counting device also comprises means for detecting the positioning of the tray (2), means for moving the tray in a direction perpendicular to the light beam, means for storing the signals representative of the data of the light beam reflected by the products (1), and means for processing said data for determining the number of products.

25 Claims, 12 Drawing Sheets

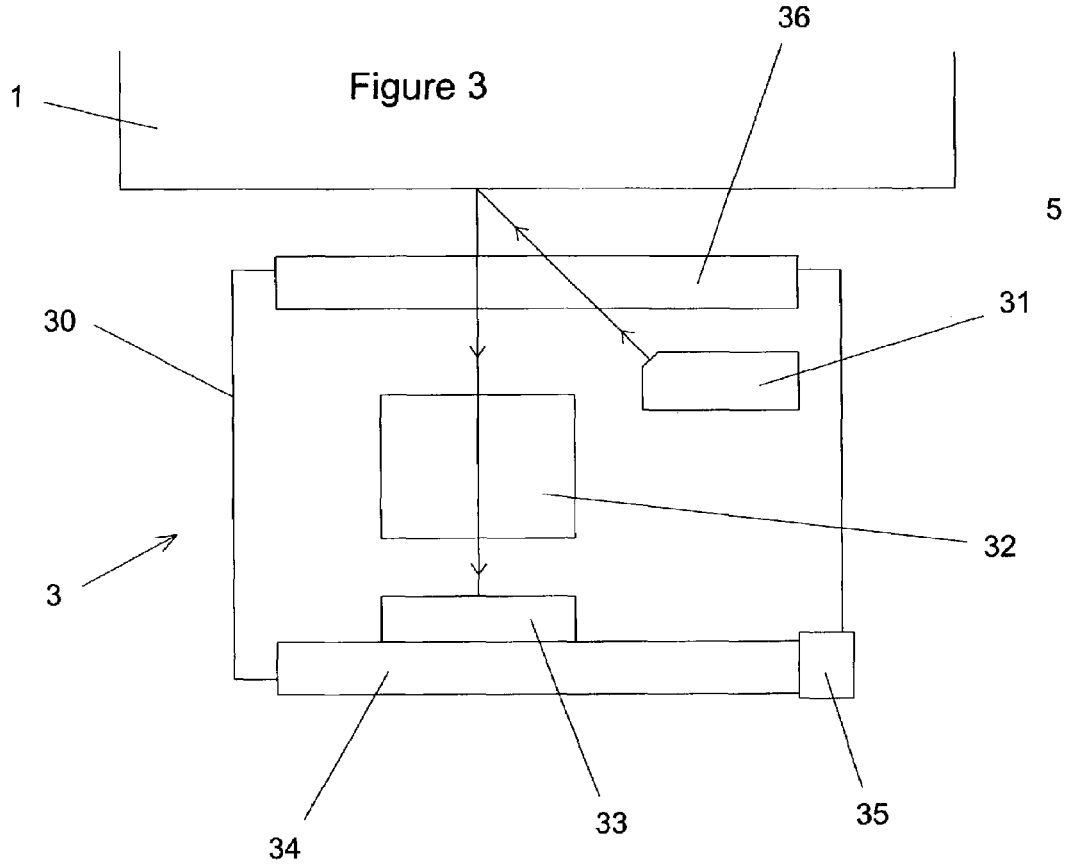
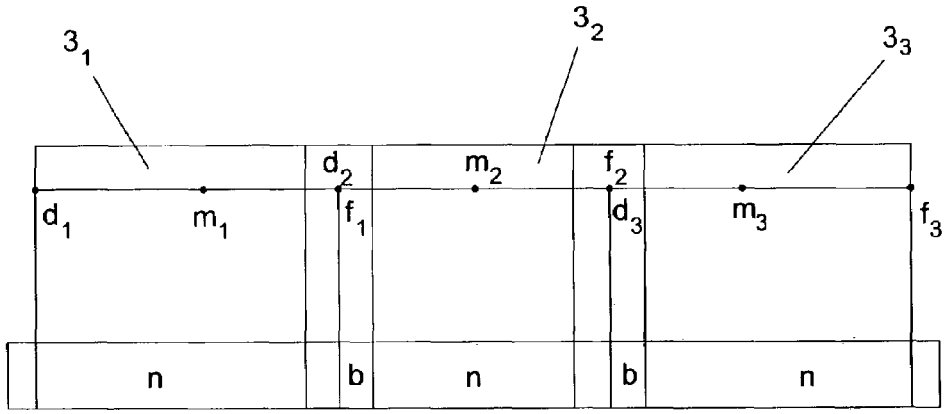
Figure 4

DEVICE FOR COUNTING STACKED PRODUCTS

FIELD OF THE INVENTION

The present invention relates to a device for counting thin products that can be stacked side by side.

BACKGROUND OF THE INVENTION

Devices are known for counting products using a matrix camera requiring the set-up of a calibration procedure thus resulting in a complex and costly apparatus.

French patent FR 2 680 027 discloses an apparatus for counting memory cards contained in opaque packaging. The apparatus comprises an electronic module and means for driving of the packaging for moving it between a source of x-rays and a detector connected to a processing circuit. The packaging as well as the card bodies being transparent to the x-rays, the detector receives a beam modified by the shadow of the electronic modules of the cards. The processing circuit can count the pulses corresponding to the passage of each module or enable display of the images obtained during the complete travel of the package between the detector and the x-ray emitter. This device can be used only for counting product having a metallic element or more generally a part that is opaque to x-rays. In addition, the x-ray source must be precisely set up so as to emit a reduced energy beam in order not to alter the opaque part.

European patent EP 676 718 discloses a device for counting thin products stacked side-by-side in a tray packaged in a translucent shrinkable film. This device comprises means for illuminating the tray, mirrors enabling transmission of the light beam reflected by the edge of the products to a linear camera, comprised of photosensitive elements, and means for transverse displacement of the tray in such a way as to carry out multiple scans, each scan being made transverse to the movement of the tray. Counting of the products is done by alternating detection of peaks and valleys. A drawback of this device is that the illumination means, the mirrors and the camera occupy considerable space. Another drawback of this device is that the measurement time is considerable due to the fact that each scan is done over the entire length of the tray.

SUMMARY OF THE INVENTION

The object of the present invention is to overcome certain drawbacks of the prior art by providing a device for counting thin products that can be stacked side-by-side, which on the one hand is simple to use and occupies little space and on the other hand makes possible reducing the measurement time so as to increase the yield of the counting device in terms of the number of products.

This object is achieved by a device for counting thin products that can be stacked side-by-side in a tray, characterized in that it comprises at least one counting station comprised of at least one CIS module whose overall length is at least equal to the length of the tray and means for performing multiple scans in a direction transverse to the tray, each CIS module comprising at least means for longitudinally illuminating the products, and at least one CIS circuit comprised of a plurality of photosensitive elements connected to at least one printed circuit, the counting device may also comprise means for detecting the position of the tray, means for moving the tray or CIS modules in a direction perpendicular to the linear beam, means for storing the signals representative of the data of the light beam reflected by the products, and means for processing said data for determining the number of products.

According to another feature, the counting device comprises a means for transport and successive presentation of trays in front of the counting station(s).

According to another feature, each CIS module comprises a lens enabling focusing of the beam reflected by the products onto the CIS circuit(s).

According to another feature, the illuminating beams of adjacent CIS modules overlapping at the most partly, the counting device comprises means for calibrating the CIS modules making it possible to define a useful reading area for each CIS module, the useful read area of a CIS module starting at the point where the useful read area of the preceding CIS module ends, and the processing means make it possible to join end to end the images read by the useful read areas of the different CIS modules.

According to a further feature, the storage means are comprised of at least as many memory bytes as there are CIS module useful photosensitive elements.

According to another feature, each pixel, comprised of 256 brightness levels provided by each photosensitive element, is combined with the adjacent pixels in order to determine the presence of products and to count them.

According to another feature, each photosensitive element can represent a combination of colors for one color CIS or even a gray level for a monochrome CIS.

According to another feature, each counting station allows detecting alternatively peaks and valleys and the processing means enable counting of peaks and valleys constituting the stored sinusoidal peak and representing the linear beam of a scan, each signal corresponding either to a tray edge or to a product to be counted.

According to another feature, the processing means enable pre-processing of the concatenated image by averaging and/or autocorrelation of the image.

BRIEF DESCRIPTION OF THE DRAWINGS

Other features and advantages of the present invention will become more apparent when reading the following description with reference to the appended drawings, wherein:

FIG. 3 represents a cross-sectional view of a CIS module;

FIG. 4 represents a functional diagram of the module calibration process;

DESCRIPTION OF THE PREFERRED EMBODIMENTS

Figure 1:
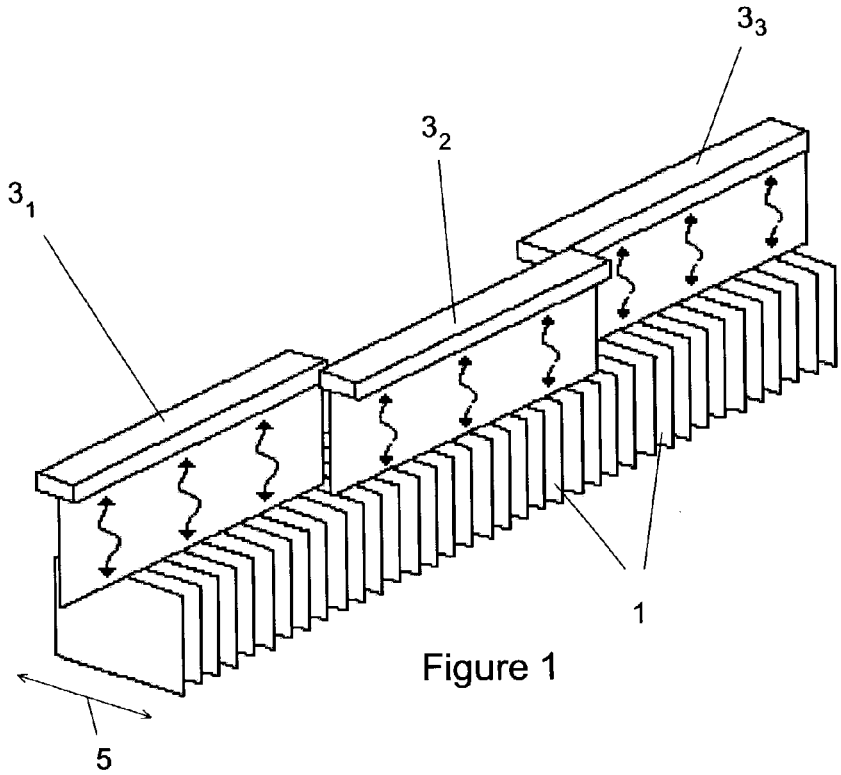
FIGS. 1 and 2 represent a perspective view and a side view, respectively, of the principle of the counting device according to the invention.
Figure 2:
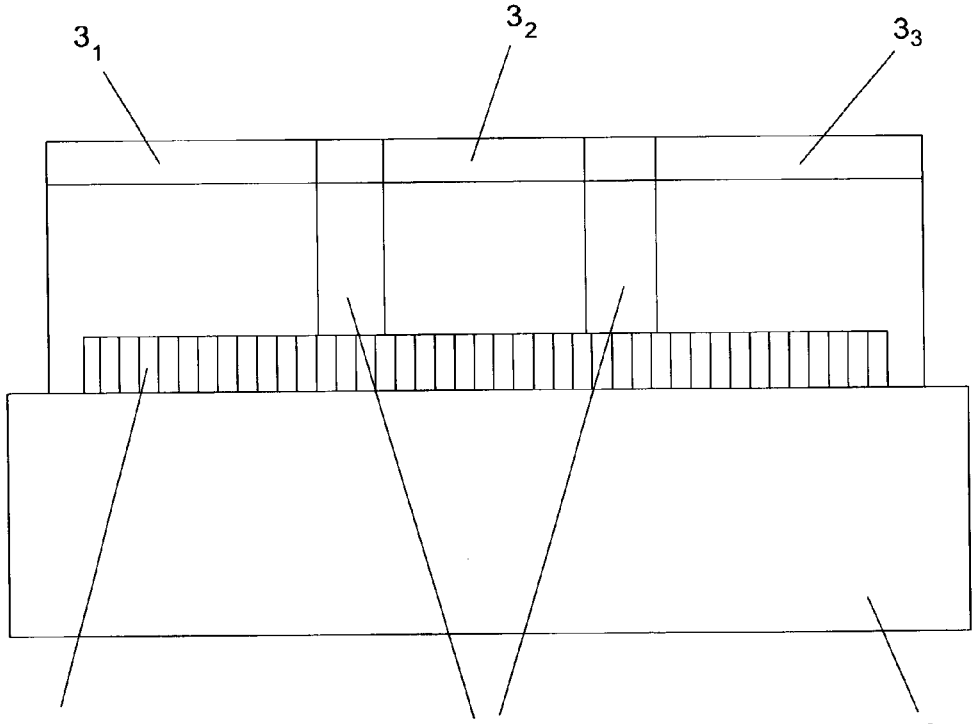

The counting device according to the invention, as can be seen particularly in FIGS. 1 and 2, makes possible counting thin products (1) stacked side-by-side such as magnetic cards or smart-cards, access badges, paper bundles, envelopes, playing cards, tickets, etc., each batch of products being, for example, packaged in a transparent shrinkable film (not shown). In order to facilitate their handling, the thin products (1) are, for example, placed in a tray (2). The counting device comprises at least one CIS (Contact Image Sensor) module (3).

A CIS module (3) such as those commercially available is comprised, as shown in FIG. 3, of a light source (31) that sends a linear light beam onto the products (1) to be counted, a lens (32) enabling focusing the beam reflected by the products onto at least one CIS circuit (33) comprised of a plurality of photosensitive elements, and a printed circuit (34) on which the CIS circuit (33) is connected. According to the invention, the printed circuit (34) is itself connected to a data processing device (not shown) by means of a connector (35) comprising a memory, enabling storage of the data contained in the light beam reflected by the products (1) to be counted, and a microprocessor, making possible processing of the data. The set of elements constituting the CIS module (3) is contained in a box (30) equipped with a window (36) that is permeable to light waves.

The use of one or several CIS module(s) rather than the complex system used in the prior art makes it possible to significantly reduce the dimensions of the counting device, while preserving satisfactory resolution (of the order of 600 dpi or better). In addition, this makes it possible to significantly reduce the measurement time (less than 2 seconds) due to the fact that the module covers the entire length of the tray.

According to the invention and as a function of the length of the batch of products (1) to be counted, a single CIS module (3) or several CIS modules ($\mathbf{3}_1$, $\mathbf{3}_2$, $\mathbf{3}_3$) can be arranged above the tray. If several CIS modules ($\mathbf{3}_1$, $\mathbf{3}_2$, $\mathbf{3}_3$) are used, these modules can be arranged either in series or in such a way that the illumination and reading areas of the beam reflected by two adjacent CIS modules overlap (4), as shown in FIGS. 1 and 2. The total length of the linear beam must be at least equal to the length of the batch of products.

By way of example, each CIS circuit (33) comprises 10,000 photosensitive elements in order to make it possible to count a batch of products (1) of, for example, a maximum of 1,000 products. Each photosensitive element of the CIS circuit (33) makes it possible to detect a light signal and to express this signal in the form of an electrical signal representing at least 256 brightness levels. This signal, for example, for 256 brightness levels, is translated into 8 bit words and each word is recorded in the memory of the device according to the invention. Thus, the memory is comprised, for the example given, of a read-write memory of 10,000 words of 1 byte each. In an alternative embodiment, the photosensitive elements of the CIS circuits (33) can be color and represent a combination of red, green or blue.

The flat light beam(s) emitted by the light source(s) (31) of the CIS module(s) ($\mathbf{3}_1$, $\mathbf{3}_2$, $\mathbf{3}_3$) represent(s) a scan longitudinal to the batch of products. The counting device according to the invention makes it possible to carry out multiple scans of the batch of products (1) by moving the tray (2) or the CIS module(s) (3) following a back-and-forth movement (5) transverse to the longitudinal axis of the arranged batch of products. The back-and-forth movement is initiated by pressing a push-button, touch screen, keyboard or any equivalent means in control (6) shown in FIG. 7 which may be arranged, for example, on or at the top of a hood (7) of the counting device according to the invention so as to cause the tray or CIS modules to effect a back-and-forth movement.

When the counting device according to the invention is equipped with several CIS modules ($\mathbf{3}_1$, $\mathbf{3}_2$, $\mathbf{3}_3$) whose read areas of the reflected beam overlap (4), calibration of the CIS modules must be done at the time of manufacture and/or at the time of maintenance of the counting device in such a way as to define the read areas to be used for each CIS module.

Figure 5:
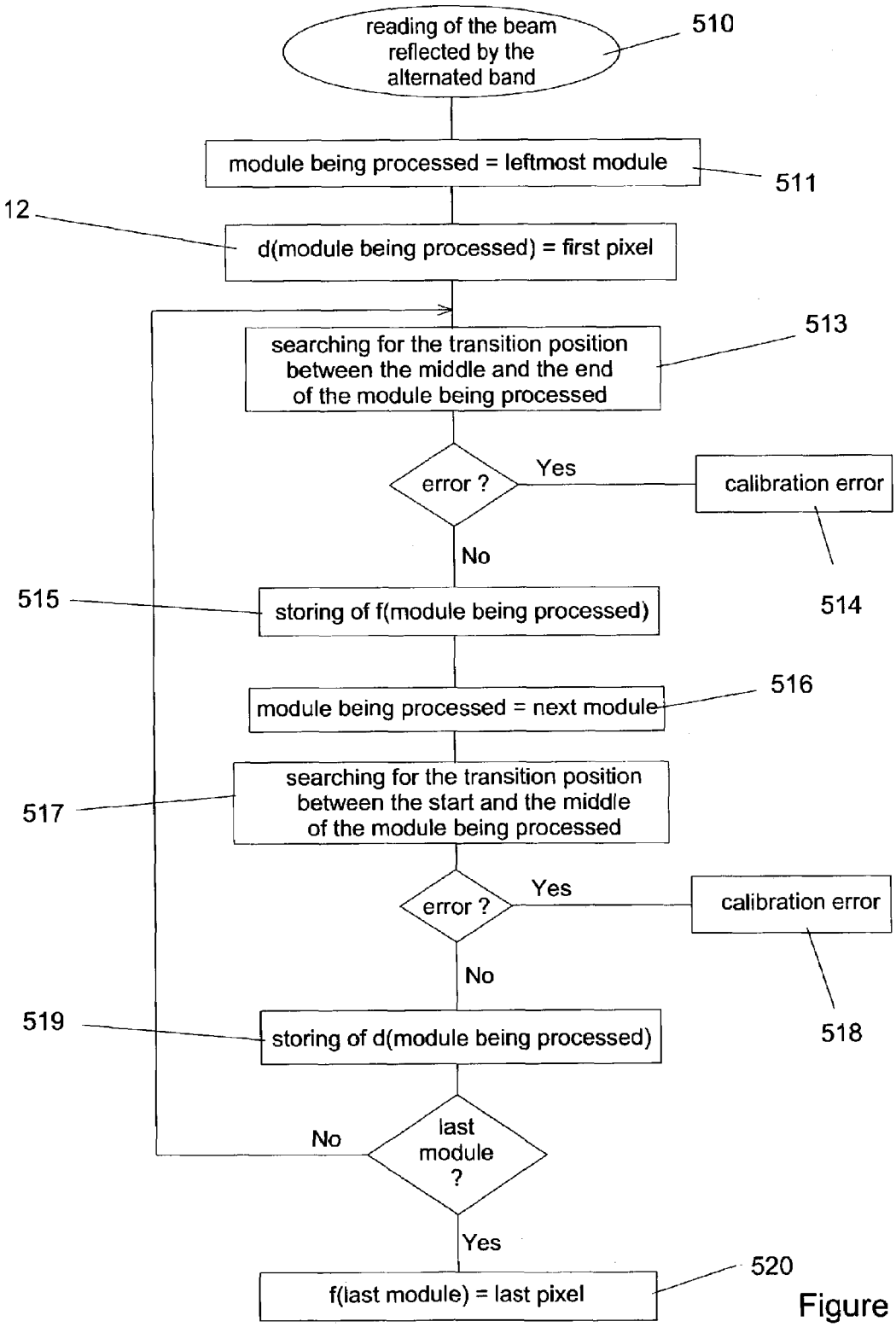
FIG. 5 represents an flow diagram representative of the module calibration process.

The principle of the calibration process is shown diagrammatically in FIG. 4. The different steps of the calibration process are represented in the form of an flow diagram in FIG. 5.

The calibration process requires the placement of a black band (n) in the position of a batch of products. White bands (b) are applied to this black band (b) in the approximate area of the illumination zones overlapped by two adjacent CIS modules.

The process for calibrating the modules starts with reading (510) the beam reflected by the different CIS modules. Then the leftmost module ($\mathbf{3}_1$) is defined (511) as the module being processed. The first pixel of the current module is then stored (512) as the starting point ($d_1$) of the read area to be used for said CIS module ($\mathbf{3}_1$), in a table of starting points of read areas.

The module calibration process is followed by the search (513) for a transition position between the middle ($m_1$, $m_2$, $m_3$) of the module being processed and the end of the module being processed. This transition position corresponds to the middle of the white band (b). If the white band is not found, the counting device according to the invention exits the calibration process by indicating (514) that a calibration error had occurred. If the white band is found, the position of the transition is stored (515) as the end ($f_1$, $f_2$) of the read area to be used for the CIS module ($\mathbf{3}_1$, $\mathbf{3}_2$) being processed, in an end of read areas table.

The next module is then defined (516) as the current module being processed. The calibration process of the modules is continued by searching (517) for the transition position (middle of the white band (b)) between the start of the module being processed and the middle ($m_1$, $m_2$, $m_3$) of the module being processed. If the white band is not found, the counting device according to the invention exits the calibration process by indicating (518) that a calibration error had occurred. If the white band is found, the transition position is stored (519) as the start ($d_2$, $d_3$) of the read area to be used for the CIS module ($\mathbf{3}_2$, $\mathbf{3}_3$) in the start of read areas table.

If the module being processed is the last module, the last pixel of said module in stored as the end ($f_3$) of the read area for this module ($\mathbf{3}_3$) in the end of read areas table.

As shown in FIG. 4, the end ($f_1$, $f_2$) of the read area to be used for the first and second CIS module ($3_1$, $3_2$), respectively, corresponds to the start ($d_2$, $d_3$) of the read zone to be used for the second and third CIS module ($3_2$, $3_3$) respectively.

Figure 6:
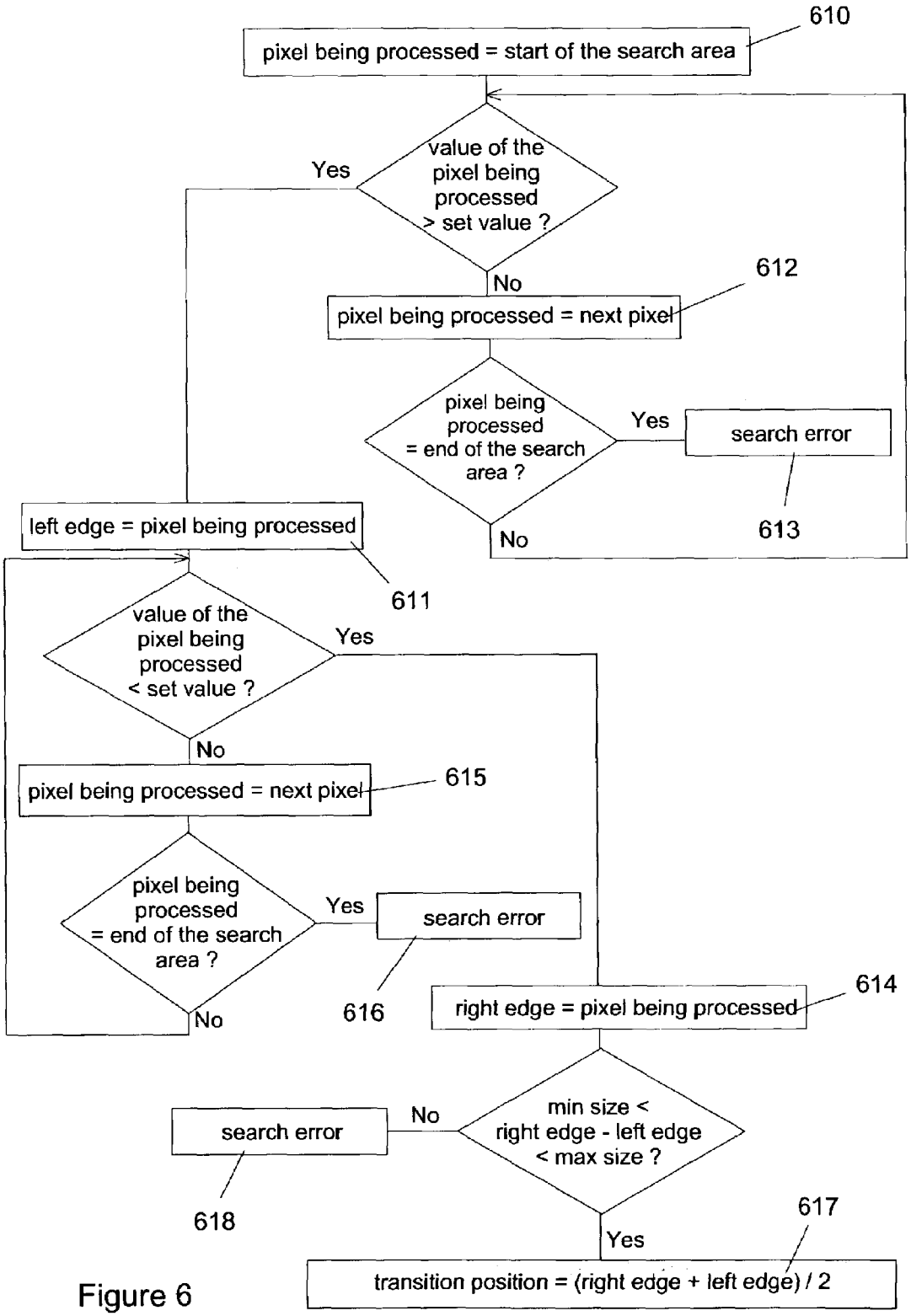
FIG. 6 represents the flow diagram representative of the transition position search process.

The search steps (513, 517) of the transition position in the module calibration process are represented in FIG. 6.

Each of the search steps (513, 517) for the transition position starts with a definition (610) of the start of the search area (from the start to the middle of the module or from the middle to the end of the module) as the pixel being processed. Then, if the value of the pixel being processed is greater than the set value, the pixel being processed is defined (611) as being the left edge of the white band (b). If this is not the case, the next pixel is defined (612) as the pixel being processed. If this pixel corresponds to the end of the search area, the counting device according to the invention exits the search process (513, 517) for the transition position by indicating (613) that a search error has occurred. If this is not the case, the value of the pixel is examined in its turn relative to the set or desired value.

Once the left edge of the white band (b) has been located, if the value of the pixel being processed is less than a set value, the pixel being processed is defined (614) as being the right edge of the white band (b). If this is not the case, the following pixel is defined (615) as the pixel being processed. If this pixel corresponds to the end of the search area, the counting device according to the invention exits the search process (513, 517) of the transition position by indicating (616) that a search error has occurred. If this is not the case, the value of the pixel is examined in its turn relative to the set value.

Once the right edge of the white band (b) is located, if the width of the white band (b) is between a minimal size and a maximal size, the transition position is stored (617) as being the middle of the white band (b). If this is not the case, the counting device according to the invention exits the search process (513, 517) for the transition position by indicating (618) that a search error has occurred.

Figure 8:
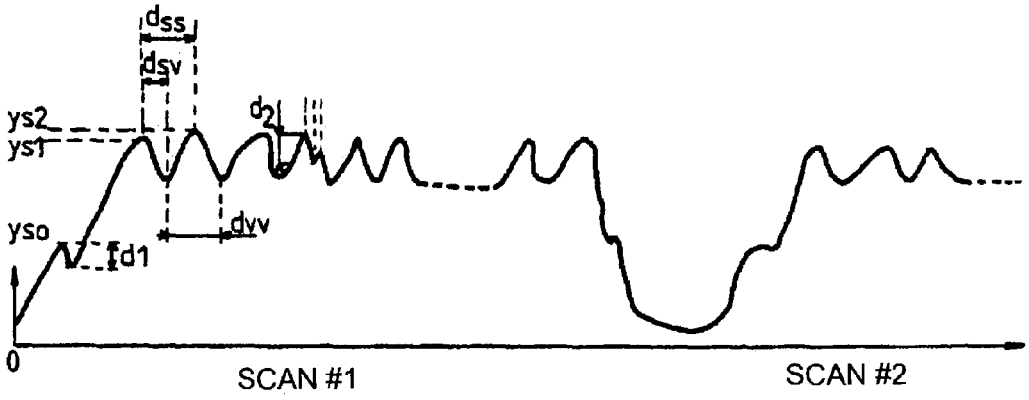
FIG. 8 represents the signal form, at the output of the CIS module, stored as bytes in the memory of the device according to the invention.

As will be seen in the following, the CIS modules (3; $3_1$, $3_2$, $3_3$) carry out, during a departure displacement, for example some fifty scans, done alternately from left to right and right to left, and during a return displacement, for example another fifty alternating scans. As shown in FIG. 8, at each scan the light signal recorded by the photosensitive elements of the CIS circuits (33) is comprised of a sinusoidal signal whose peaks represent approximately the middles of the product and the valleys represent the edges and the distance separating two valleys corresponds to the thickness of one product to be counted. The first peak of coordinates ys0 corresponds in fact to a detection edge of the tray, while the first peak ys1 corresponds to the first product to be counted.

Between scan N° 1 and scan N° 2, the microprocessor of the counting device according to the invention, controlled by a program implementing the hereinafter described algorithms, makes it possible to carry out processing of the data stored in the course of the first scan, before validating storing of a second scan, represented in FIG. 7.

The program for reading of the stored scans and counting the products corresponds to the implementation of the algorithms represented in FIGS. 9 to 15.

Figure 9:
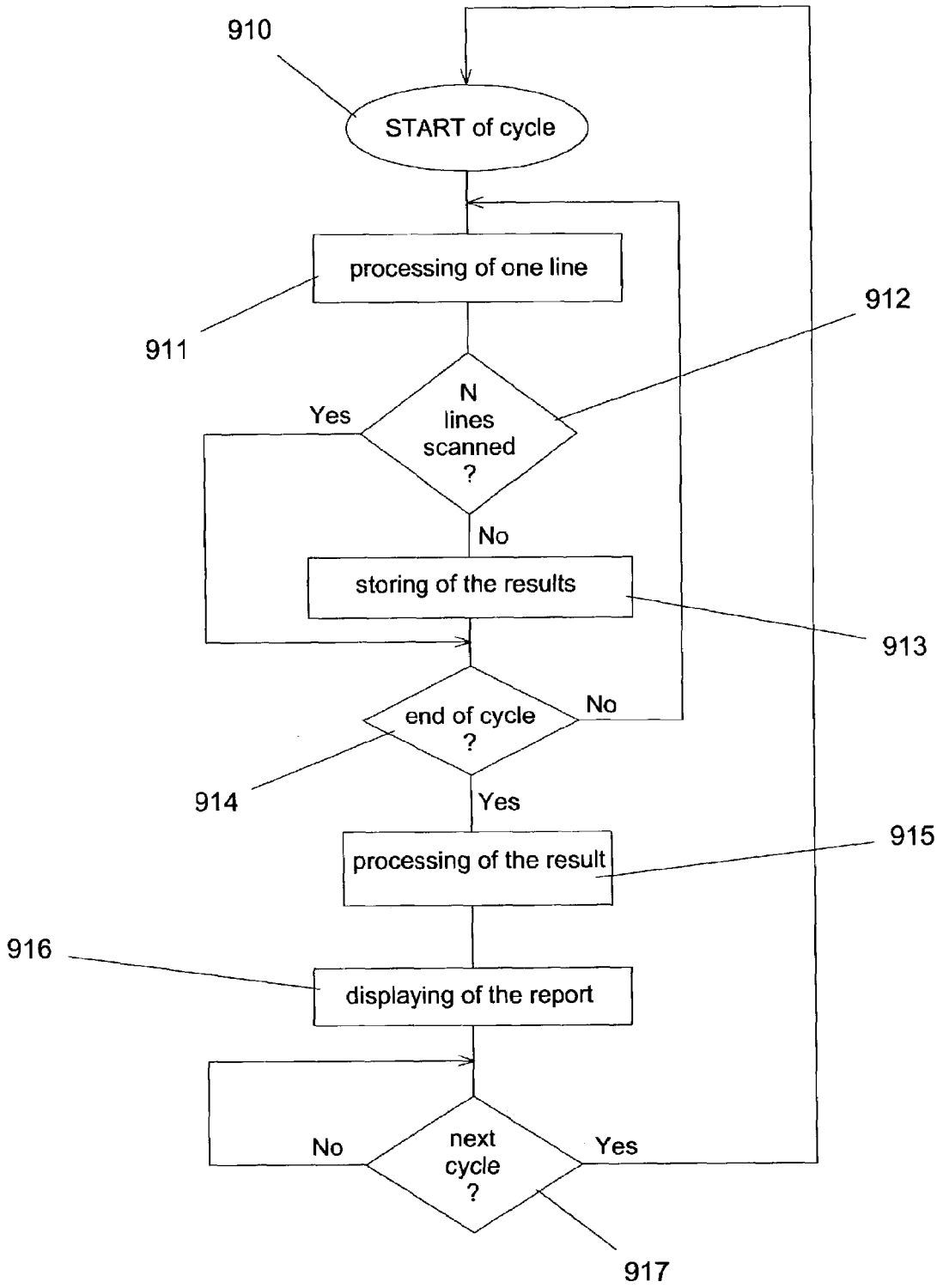
FIG. 9 represents the flow diagram representative of the counting operation progress.

The counting process implemented by the counting device according to the invention is represented in FIG. 9. It starts when the push-button is pressed by the user (910). The process consists then in carrying out processing (911) of a line, then performing a test (912) to establish if a specific number of lines, 100 for example, has been scanned. If the answer is no, the results are stored (913), then a test (914) is done in order to determine if the specific number of linear scans has been carried out. If the answer is yes, the test (914) is done directly, without storing (913) of the results. If the specific number of linear scans has not been done, the program processes (911) the following line. In the alternative, the process is followed by processing (915) of results, then by display (916) of a report. Finally, a test (917) is done in order to establish if proceeding to a following cycle is necessary. If the answer is no, the test (917) is repeated in order to establish if proceeding to a subsequent cycle is occasioned. If the answer is yes, that is, if the device according to the invention detects that the pushbutton has been pressed again, the process repeats from the step (910).

Figure 10:
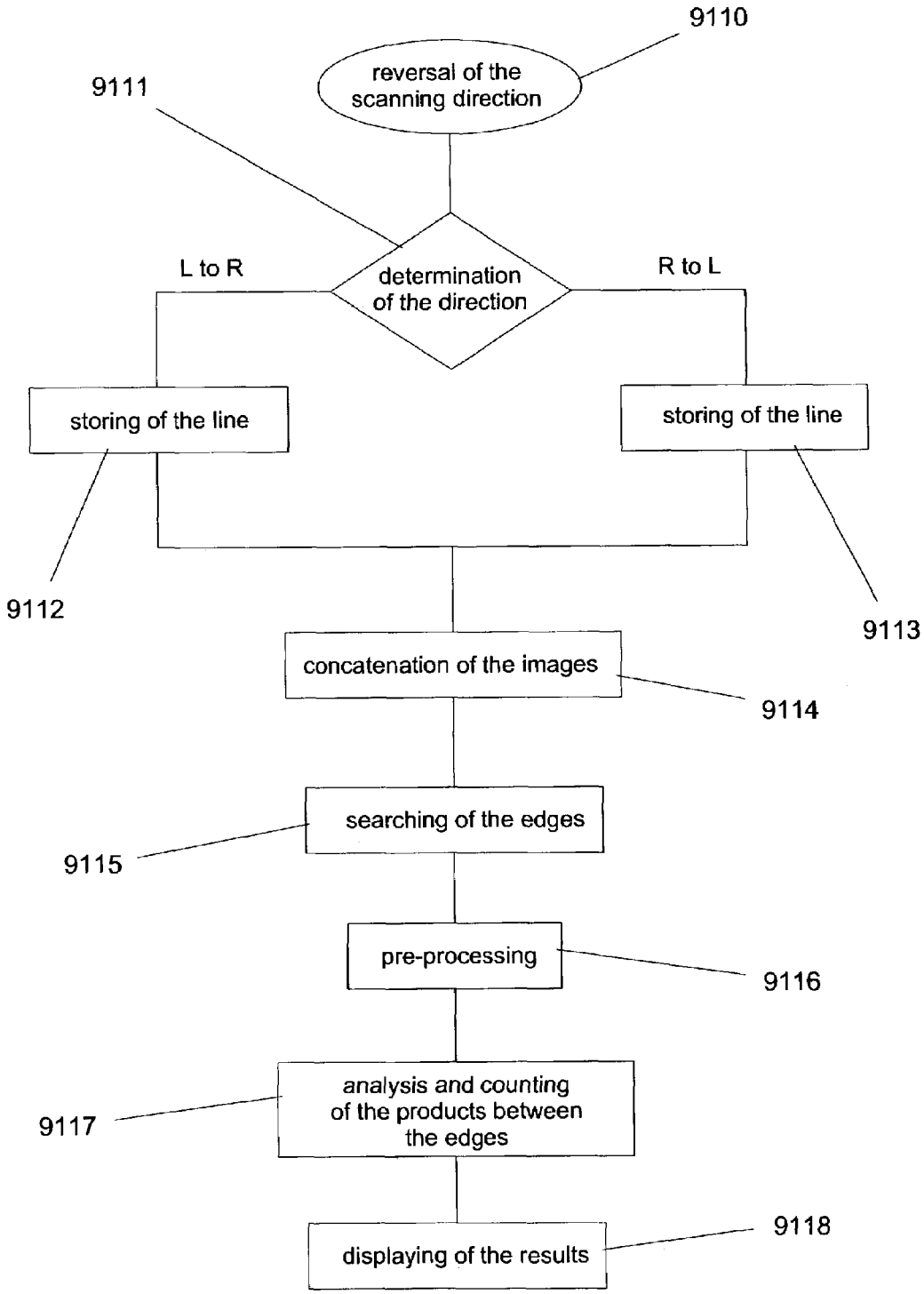
FIG. 10 represents the flow diagram representative of the processing of a line.

The step of processing (911) a line corresponds to the succession of steps represented in FIG. 10.

The step of processing (911) a line begins with a reversal of the scanning direction (9110) and is followed by a test step (9111) for determination of the direction. In the case of left-to-right scanning, the line is stored at step (9112) and in the case of right-to-left scanning, the line is stored at step (9113). Each of these steps (9112, 9113) is followed, if the counting device according to the invention is equipped with several CIS modules, by a step of concatenation (9114) of the images read by the different CIS modules. The step of processing (911) a line is followed, successively, by a step of search (9115) of the tray edges, by a data pre-processing (9116) step, by a step of analysis and counting (9117) the products (1) to be counted, and a results display (9118) step.

Figure 11:
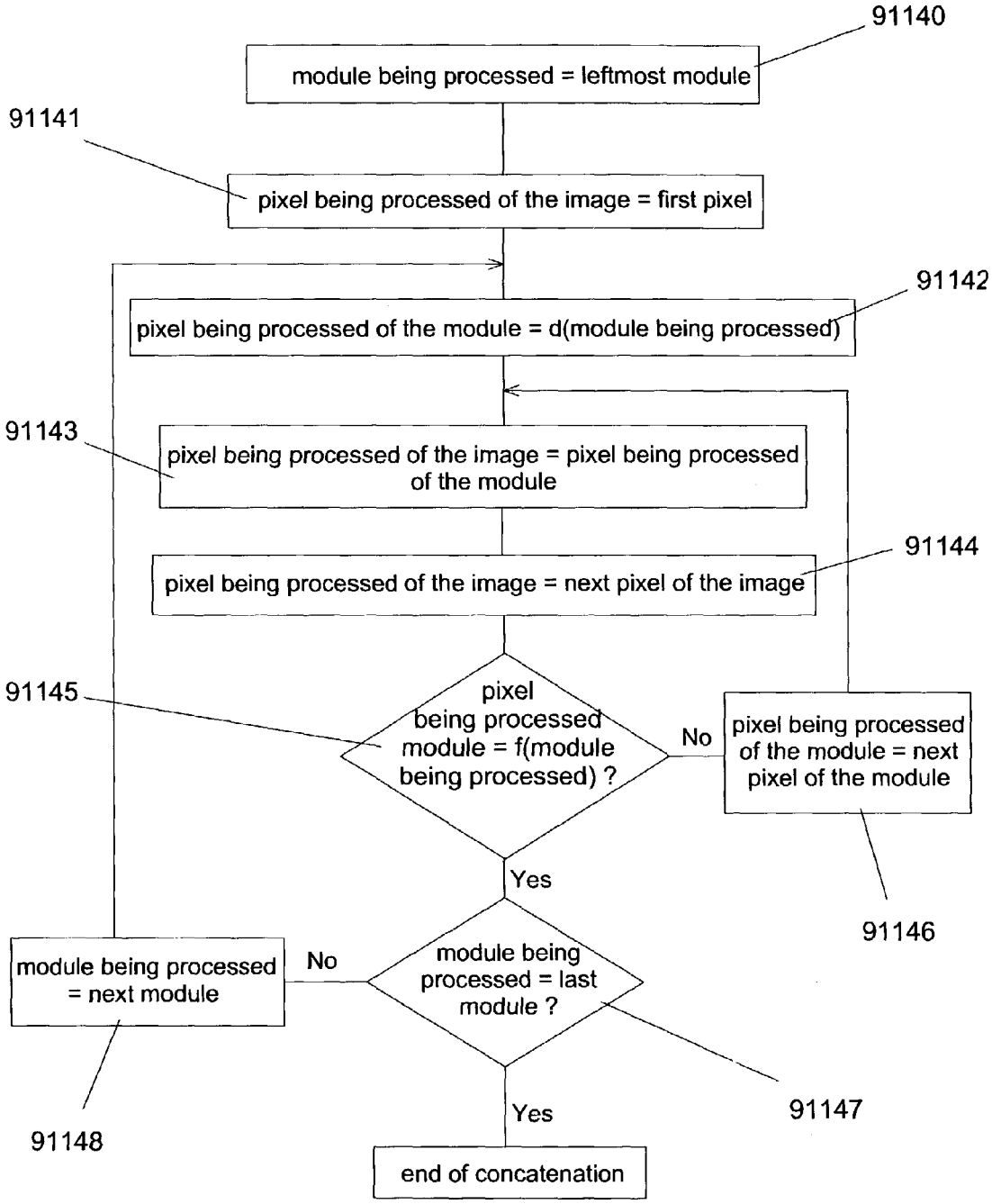
FIG. 11 represents the flow diagram representing the image concatenation process.

The step of concatenation (9114) of the images is represented in FIG. 11. It makes it possible to avoid overlap of the images by taking into account read areas defined for each CIS module during the process of calibration of the modules.

The step of concatenation (9114) of the images starts with a definition (91140) of the leftmost module as the module being processed, then with a definition (91141) of the first pixel of the image to be reconstituted as the pixel being processed of said image. The start of the read area ($d_1$, $d_2$, $d_3$) to be used is then defined (91142) as the pixel being processed of the module ($3_1$, $3_2$, $3_3$). Then the pixel being processed of the module is defined (91143) as the pixel being processed of the image. Then the pixel being processed of the image is incremented (91144). A test (91145) is then performed for determining if the pixel being processed corresponds to the end of the read area ($f_1$, $f_2$, $f_3$) to be used. If the answer is no, the pixel of the module is incremented (91146), a step that is followed by the step of definition (91143) of the pixel being processed of the module as the pixel being processed of the image. If the answer is yes, a test (91147) is done for determining if the module being processed is the last module. If the answer is no, the module is incremented (91148), a step followed by the step of definition (91142) of the start of the read area ($d_1$, $d_2$, $d_3$) to be used as the pixel being processed of the module ($3_1$, $3_2$, $3_3$). If the answer is no, the concatenation step is completed.

Figure 12:
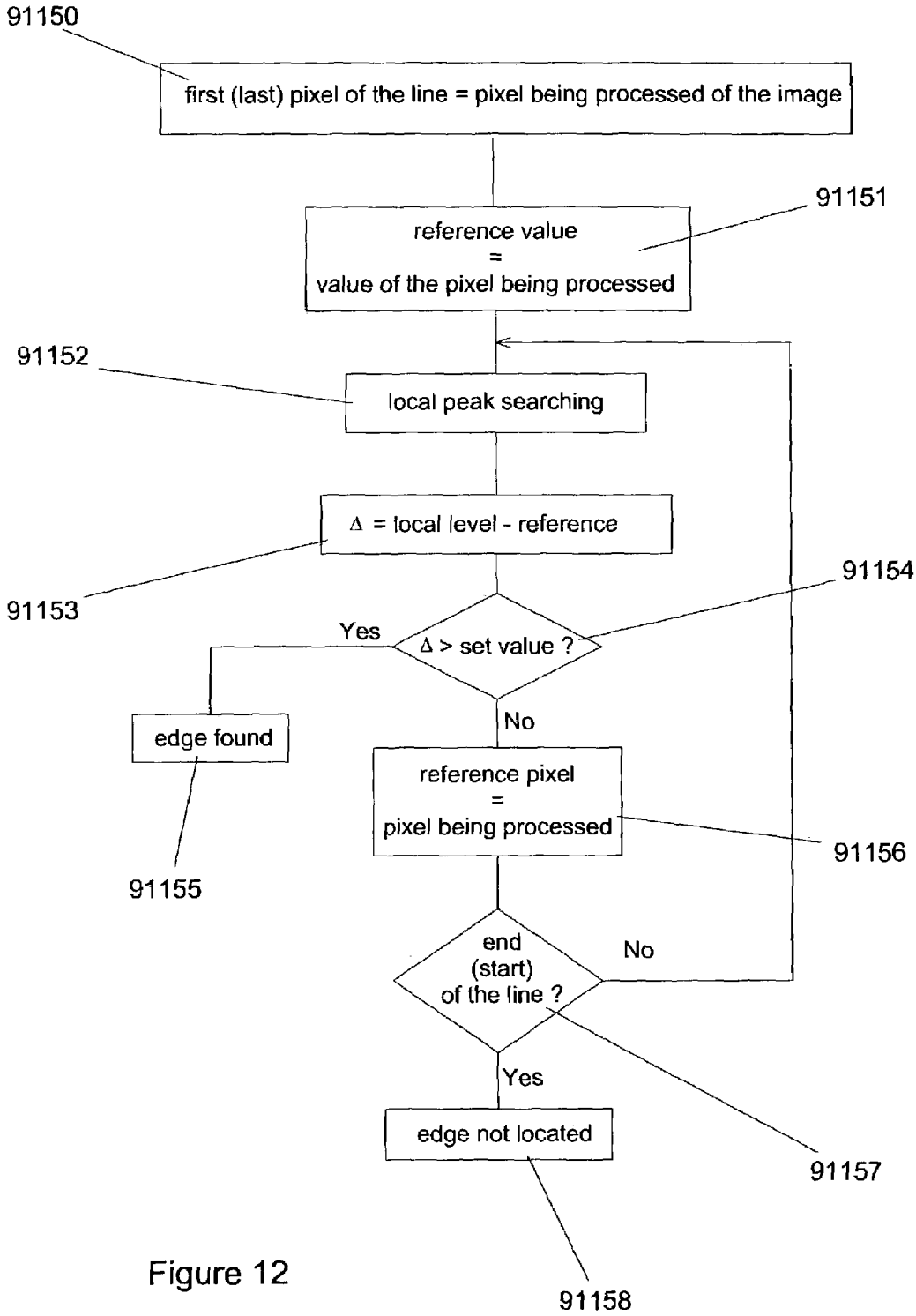
FIG. 12 represents the flow diagram representative of the process for locating the edges of the tray containing the products.

The step of searching (9115) for the tray edges (2) is represented in FIG. 12. This search step is performed two times: a first time for determining the edge of the tray situated farthest to the left and a second time for determining the edge of the tray situated farthest to the right. The step of searching (9115) for the edges starts with a definition (91150) step of the first (respectively, last) pixel of the line stored as the pixel being processed of the image. After this step, a step occurs for definition (91151) of the value of pixel being processed as the reference value. This information is comprised of an 8 bit word representative of one of the 256 brightness levels received by the photosensitive element of the CIS module corresponding to the processed memory word. After this step a search (91152) step for the local peak occurs, which is followed by a step for calculating (91153) the difference between the local level and the reference value stored in the step (91151). The step of searching (9115) for the edges is followed by a test (91154) step for determining if this difference is greater than a set value. If the answer is yes, one edge was located and the position of the corresponding pixel is stored (91155). If the answer is no, the step of searching (9115) for the edges is followed by a step for storing (91156) the pixel being processed as the reference pixel. After this step a test (91157) step occurs for determining if this is the end (respectively, the start) of a line. If the answer is no, the step of searching (9115) for the edges is followed by the step of searching (91152) for the local peak. If the answer is yes, the device stores (91158) the fact that the edge has not been located.

The set value of the step (91154) corresponds generally to the difference in brightness level that separates on average a peak from a valley and, as can be seen in the diagram in FIG. 8, the step of searching (9115) for the edges makes it possible to detect the peak ys0 as an edge and then, as will be seen later, during the processing of the valley, as it notices that the brightness level difference $d_1$ between the peak and the following valley is less than another setting and that the percentage of variation of peaks is greater than a specific value, it assumes that it is not an edge of the tray and detects the following peak ys1 as being the actual edge of the tray.

Figure 13:
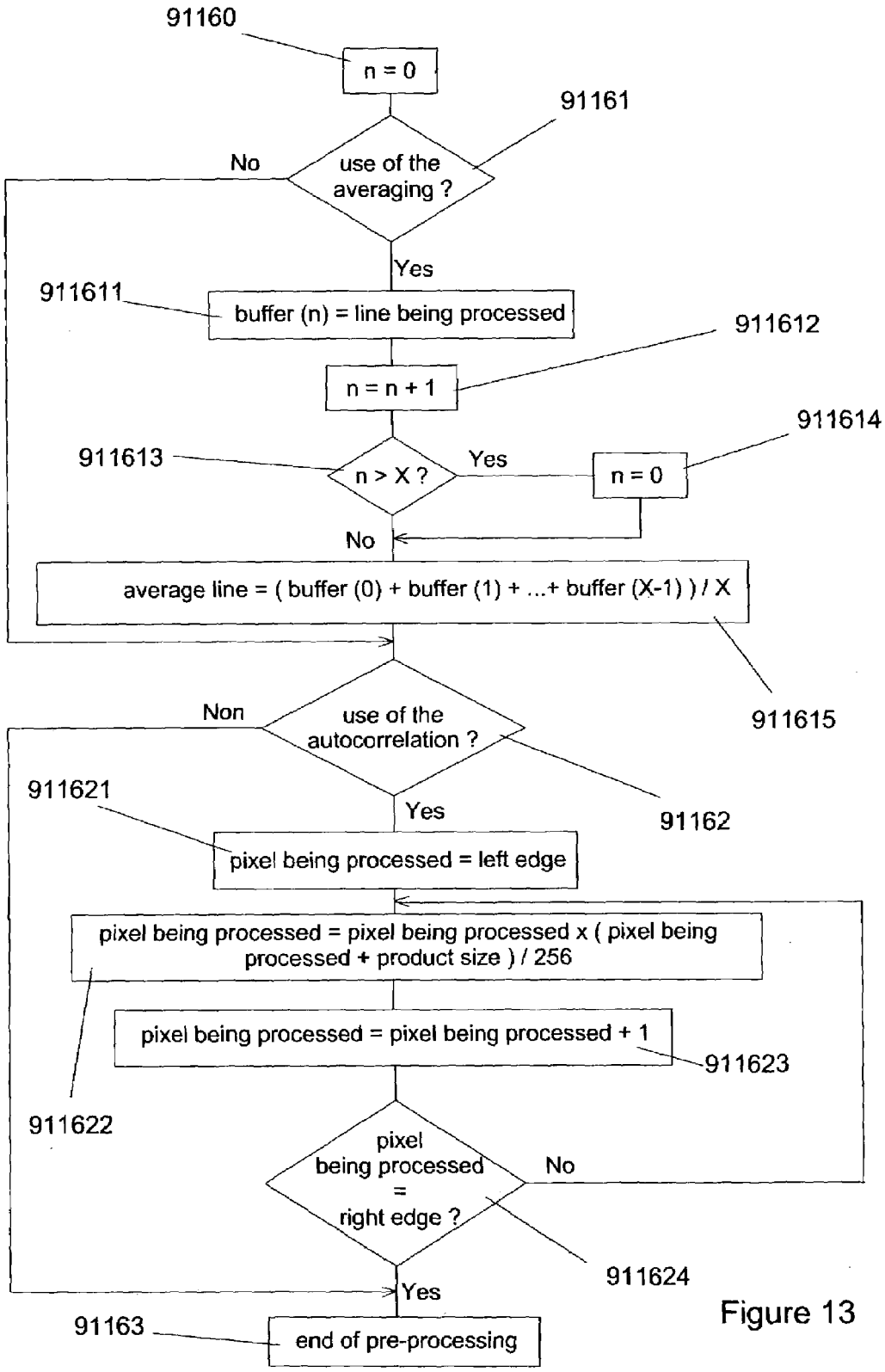
FIG. 13 represents the flow diagram representative of the pre-processing process.

The data pre-processing (9116) step, represented in FIG. 13, is an optional step of the counting process according to the invention. It makes possible averaging of a determined number of lines in order to diminish background noise and/or to auto-correlate the image in order to reinforce the signal waveform.

The pre-processing (9116) step starts with a step for initializing (91160) the index n to zero, which is done at the moment of initiation of the cycle (910, FIG. 9) and storing in each of the X buffer memories of the line currently being processed. The pre-processing (9116) step is followed by a test (91161) for determining, according to the configuration of the counting device, if the use of averaging is appropriate. If the answer is no, the pre-processing step (9116) is followed by a test (91162) for determining, according to the configuration of the counting device, if the use of autocorrelation is appropriate. If the use of averaging is appropriate, the pre-processing step (9116) is followed by storing (911611) in the buffer memory n associated with the line in process, of the line currently being processed, then by incrementation (911612) of the index of the buffer memory. The pre-processing (9116) step is followed by a test (911613) for determining if the buffer memory index in process (n) exceeds the number of lines to be averaged (X). If the answer is yes, the index of the buffer memory in process is reset to zero (911614), then the current line is calculated (911615) by averaging, pixel-by-pixel, over all lines (X) stored in the X buffer memories. If the answer is no, the pre-processing (9116) step is followed directly by the calculation (911615) step. The next step is a test (91162) for determining, according to the configuration of the counting device, if the use of autocorrelation is appropriate. If the answer is no, the pre-processing step (9116) is completed (91163). If the answer is yes, the pre-processing (9116) step is followed by definition (911621) of the left edge of the tray as the pixel being processed, then by calculation (911622) of autocorrelation of the pixel being processed. The pixel being processed is then incremented (911623), then a test (911624) is performed for determining if the pixel being processed corresponds to the right edge of the tray. If the answer is yes, the pre-processing step (9116) is completed (91163). If the answer is no, the pixel being processed is calculated (911622) according to the autocorrelation formula of FIG. 13.

Figure 14:
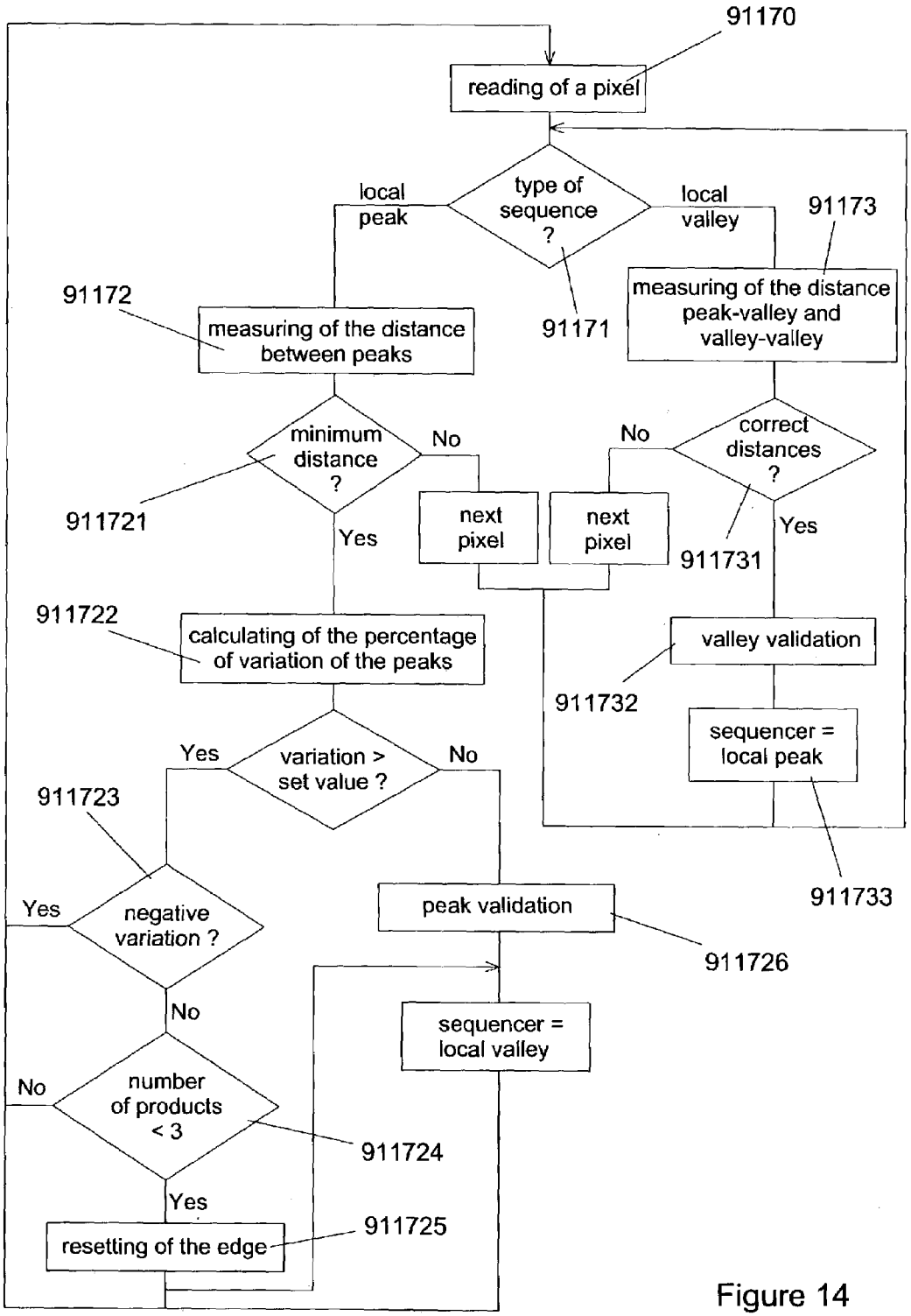
FIG. 14 represents the flow diagram representative of the product analysis and counting process.
Figure 15:
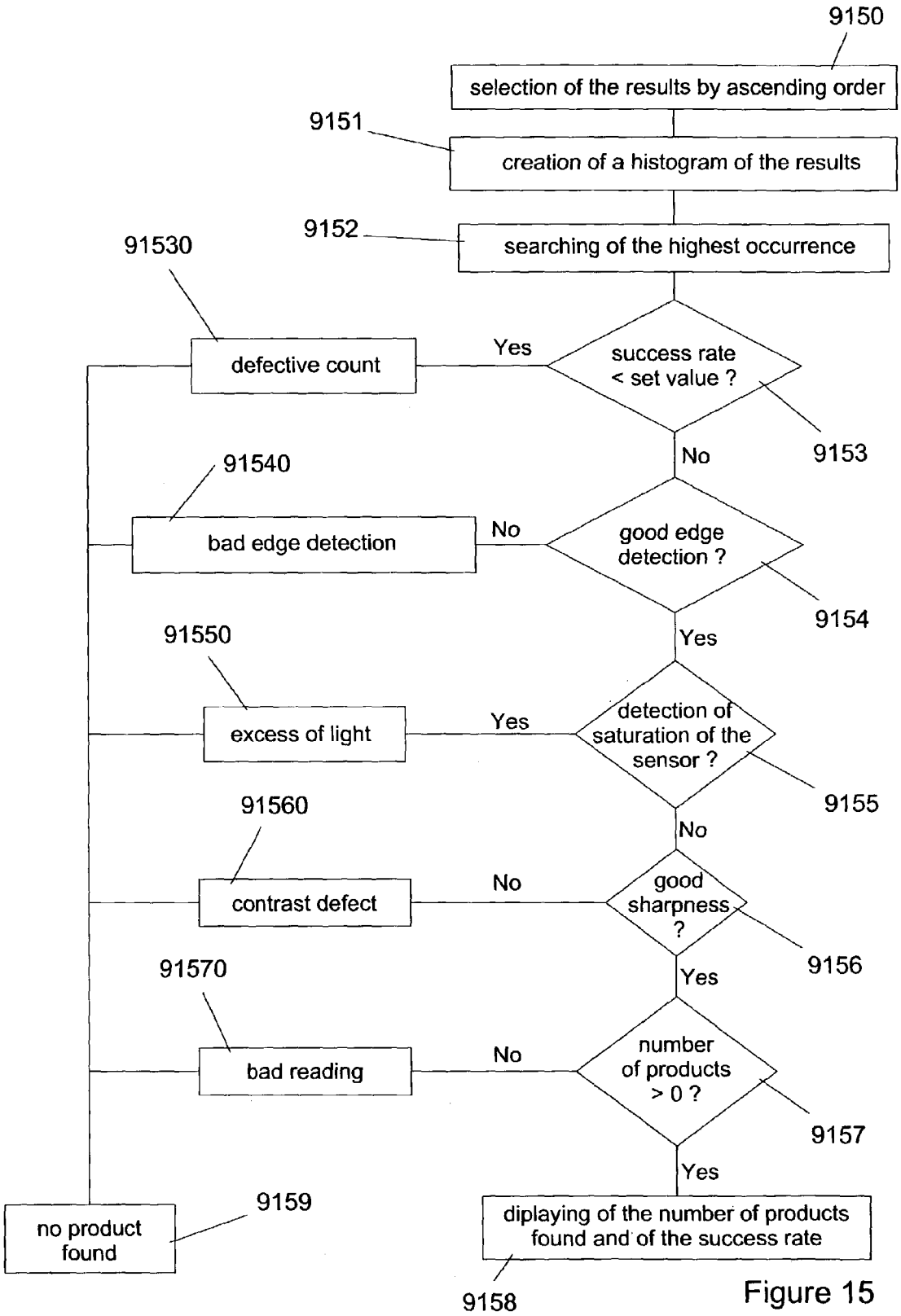
FIG. 15 represents the flow diagram representative of the process for processing the results.

The step of analysis and counting (9117) the products (1) between the edges is represented in FIG. 14. It starts with a step of reading (91170) a pixel and is followed by a test (91171) step involving the type of sequence. This test is done by determining if the difference between the pixel currently being processed and the preceding pixel is positive or negative and, in the case wherein it is positive, engaged the "local peak" processing process and, if negative, engages the "local valley" processing process.

The "local peak" processing process starts with a step of measuring (91172) the distance (dss) between peaks and continues with a test (911721) step for determining if this distance (dss) is greater than a minimum distance. If the answer is no, the "local peak" processing process is continued with a step of processing of the next pixel and with the test (91171) involving the type of sequence. If the answer is yes, the "local peak" processing process is followed by a step for calculating (911722) the percentage of variation of the peaks: (ys2−ys1)×100/ys1. If this variation is greater than a set value, the "local peak" processing process is followed by a test (911723) step for determining if the variation is negative. If the answer is yes, the "local peak" processing process is followed by the pixel reading step (91170). If the variation is positive, the "local peak" processing process is followed by a test (911724) step consisting of reading the contents of the counter of the number of products and determining if the contents of this counter is less than three. If the answer is no, the "local peak" processing process is followed by the pixel reading step (91170). If the answer is yes, the program is followed by a resetting (911725) of the edge by considering that the peak processed is in fact the actual edge of the tray. This corresponds exactly to the situation where, in a first stage, the "local peak" processing process detected ys0 and which then, on detecting ys1, it confirms that the variation for ys1 is greater than the set value and then, verifying that the number of products is less than 3, it considers that ys1 is the actual edge of the group of products to be counted. If the variation is less than the set value, the "local peak" processing process validates (911726) the peak by incrementing a counter which counts the peaks.

This step of validation (911726) of a peak is followed by a jump to the local valley sequencer by sending the step of analysis and counting (9117) of the products to ahead of the sequence type test (91171) step, for processing a local valley according to the following "local valley" processing process.

This "local valley" processing always starts with the test (91171) involving the type of sequence and is then followed by a step measuring (91173) the peak—valley distance (dsv) and the valley—valley distance (dvv). After this step a test (911731) step occurs for determining if the two distances (dsv, dvv) are correct relative to reference values. If this is not the case, the "local valley" processing process is followed by processing of the next pixel and the sequence type test (91171) step. If in the case where the distances are correct, the "local valley" processing process is followed by a valley validation (911732) step that consists in incrementing a valley counter. This step is followed by a jump to the local peak sequencer by sending the product analysis and counting (9117) step ahead of the sequence type test (91171)

test in order to process a local peak in accordance with the "local peak" processing process.

After this product analysis and counting (9117) step for each scan wherein the number of products counted is stored for each scan, the counting process according to the invention comprises a step for processing (915, FIG. 9) the results, after the microprocessor of the counting device according to the invention has determined that it is an cycle end step (914, FIG. 9). The step of processing (915) the results is represented in FIG. 12. It starts with a selection (9150) of the results in ascending order and continues with a creation (9151) of a histogram of the results and a search (9152) of the highest occurrence in the results. Thus, using a hundred scans, the microprocessors is capable of determining, for example, that the number 950 recurs more frequently than the number 939, 940 or 945. The number 950 is thus stored and the results processing (915) step is followed by a test (9153) for determining if the success rate of this higher-occurrence number is less than a set value. If, for example, the value 950 recurs more than 7 times out of 8 counts, the microprocessor considers that the set value has been reached and the results processing (915) step is followed by a test (9154) step for determining if edge detection has been satisfactory. If this is not the case, the counting device according to the invention signals (91530) a defective count and displays (9159) "no product found." This test step (9154) for edge detection consists of reading a flag which will have been positioned during the steps (91155, FIG. 12 or 911725, FIG. 14), indicting that the edges have been effectively detected. If this is not the case, the counting device according to the invention signals (91540) a defective edge detection and displays (9159) "no product found." If the answer is yes, however, the results processing (915) step is followed by a test (9155) step for detection of saturation of the photosensitive elements of the CIS circuits. If this is the case, the counting device according to the invention signals (91550) that there is an excess of light and displays (9159) "no product found." If this is not the case, the results processing (915) step is followed by a test (9156) step for determining if the information read was of satisfactory sharpness. If this is not the case, the counting device according to the information signals (91560) a contrast defect and displays (9159) "no product found." If the answer is yes, however, the results processing (915) step is followed by a test (9157) step involving the number of products for determining if this number is greater than zero. If this is not the case, the counting device according to the invention signals (91570) unsatisfactory reading and displays (9159) "no product found." If the answer is yes, however, the results processing step (915) is completed by a step displaying (9158) the number of products and the success rate.

Figure 7:
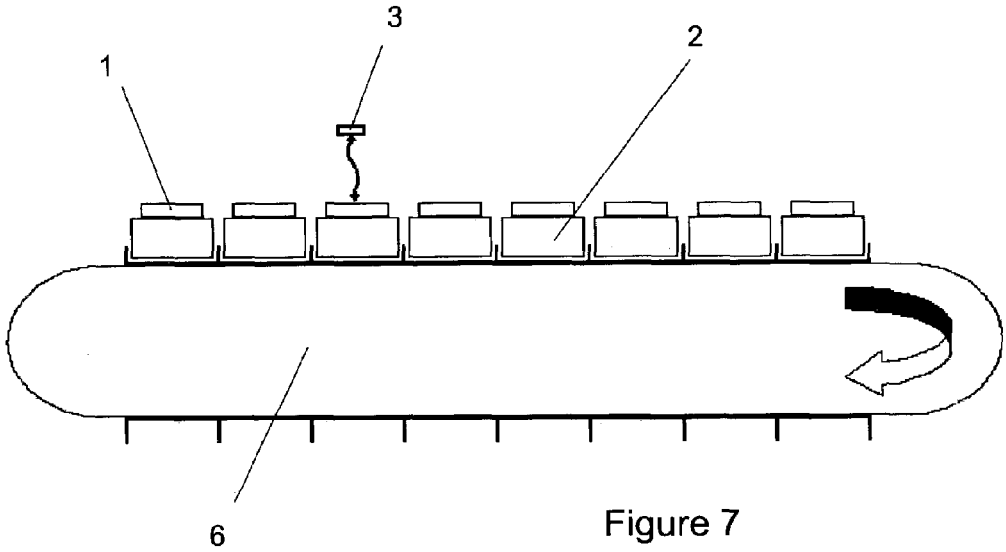
FIG. 7 represents a diagrammatic side view of a second embodiment of the principle of the counting device according to the invention.

FIG. 7 represents another variant of the mechanical tray displacement device (2) under the reading beam in such a way as to be able to carry out a plurality of scans transverse relative to the direction of movement of the tray. As can be seen, these trays (2) are arranged on a stopper belt (6), itself held between two drive pulleys (P), one at least of which is driven in rotation by an electrical motor (M) supplied sequentially after processing of the 100 lines of scan or the desired number of lines of scan for achieving a sufficient success rate.

It should be obvious to the person skilled in the art, that the present invention makes possible embodiments in many other specific forms without departing from the field of application of the invention as claimed. Consequently, the present embodiments must be considered to be illustrative but capable of modification within the field defined by the scope of the annexed claims and the invention is not limited to the specifics recited hereinbefore.

The invention claimed is:

1. A device for counting thin products (1) that can be stacked side-by-side in a tray (2), characterized in that it comprises at least one counting station comprised of at least one contact image sensor (CIS) module (3; $\mathbf{3}_1$, $\mathbf{3}_2$, $\mathbf{3}_3$), whose overall length is at least equal to the length of the tray (2) in which the products (1) are stacked and means for performing multiple scans in a direction transverse to the tray (2), each CIS module (3; $\mathbf{3}_1$, $\mathbf{3}_2$, $\mathbf{3}_3$) comprising at least means (31) for longitudinally illuminating the products (1) with a linear light beam and at least one CIS circuit (33), said CIS circuit comprising a plurality of photosensitive elements connected to at least one printed circuit (34), means for detecting positioning of the tray (2), means for moving the tray or CIS modules in a direction perpendicular to the linear light beam, means for storing signals representative of data derived from the linear light beam reflected by the products (1), and means for processing said data for determining the number of products.

2. The counting device according to claim 1, further comprising a means (6) for transport and successive presentation of trays (2) in front of the counting station.

3. The counting device according to claim 1, characterized in that each CIS module ($\mathbf{3}_1$, $\mathbf{3}_2$, $\mathbf{3}_3$) comprises a lens (32) for focusing the beam reflected by the products (1) onto the CIS circuit (33).

4. The counting device according to claim 1, comprising a plurality of adjacent CIS modules arranged such that the illuminating beams of adjacent CIS modules partly overlap and means for calibrating the CIS modules ($\mathbf{3}_1$, $\mathbf{3}_2$, $\mathbf{3}_3$), to define a useful read area for each CIS module, the useful read area of a CIS module starting at the point where the useful read area of the preceding CIS module ends, and wherein the processing means joins the images read end to end by the useful read areas of the different CIS modules.

5. The counting device according to claim 2, comprising a plurality of adjacent CIS modules arranged such that the illuminating beams of adjacent CIS modules partly overlap and means for calibrating the CIS modules ($\mathbf{3}_1$, $\mathbf{3}_2$, $\mathbf{3}_3$), to define a useful read area for each CIS module, the useful read area of a CIS module starting at the point where the useful read area of the preceding CIS module ends, and wherein the processing means joins the images read end to end by the useful read areas of the different CIS modules.

6. The counting device according to claim 3, comprising a plurality of adjacent CIS modules arranged such that the illuminating beams of adjacent CIS modules partly overlap and means for calibrating the CIS modules ($\mathbf{3}_1$, $\mathbf{3}_2$, $\mathbf{3}_3$), to define a useful read area for each CIS module, the useful read area of a CIS module starting at the point where the useful read area of the preceding CIS module ends, and wherein the processing means joins the images read end to end by the useful read areas of the different CIS modules.

7. The counting device according to claim 4, characterized in that the storage means comprises at least as many memory bytes as there are CIS module useful photosensitive elements.

8. The counting device according to claim 5, characterized in that the storage means comprises at least as many memory bytes as there are CIS module useful photosensitive elements.

9. The counting device according to claim 6, characterized in that the storage means comprises at least as many memory bytes as there are CIS module useful photosensitive elements.

10. The counting device according to claim 7, wherein each photosensitive element comprises 256 brightness levels forming a pixel, and each pixel is combined with the adjacent pixels to determine the presence of products (1) and to count them.

11. The counting device according to claim 8, wherein each photosensitive element comprises 256 brightness levels forming a pixel, and each pixel is combined with the adjacent pixels to determine the presence of products (1) and to count them.

12. The counting device according to claim 9, wherein each photosensitive element comprises 256 brightness levels forming a pixel, and each pixel is combined with the adjacent pixels to determine the presence of products (1) and to count them.

13. The counting device according to claim 7, wherein the CIS is a color CIS and each photosensitive element represents one combination of colors for the color CIS.

14. The counting device according to claim 10, wherein the CIS is a color CIS and each photosensitive element represents one combination of colors for the color CIS.

15. The counting device according to claim 7, wherein the CIS is a monochrome CIS and each photosensitive element represents one combination of gray level images for the monochrome CIS.

16. The counting device according to claim 10, wherein the CIS is a monochrome CIS and each photosensitive element represents one combination of gray level images for the monochrome CIS.

17. The device according to claim 4, wherein each counting station is disposed to detect alternate peaks and valleys, each peak corresponding either to a tray (2) edge or to a product (1) to be counted, and the processing means counts peaks and valleys constituting a stored sinusoidal signal representative of the stored linear beam of a scan.

18. The device according to claim 7, wherein each counting station is disposed to detect alternate peaks and valleys, each peak corresponding either to a tray (2) edge or to a product (1) to be counted, and the processing means counts peaks and valleys constituting a stored sinusoidal signal representative of the stored linear beam of a scan.

19. The device according to claim 10, wherein each counting station is disposed to detect alternate peaks and valleys, each peak corresponding either to a tray (2) edge or to a product (1) to be counted, and the processing means counts peaks and valleys constituting a stored sinusoidal signal representative of the stored linear beam of a scan.

20. The device according to claim 13, wherein each counting station is disposed to detect alternate peaks and valleys, each peak corresponding either to a tray (2) edge or to a product (1) to be counted, and the processing means counts peaks and valleys constituting a stored sinusoidal signal representative of the stored linear beam of a scan.

21. The counting device according to claim 4, characterized in that the processing means enable pre-processing of a concatenated image by averaging and/or by autocorrelation of the image.

22. The counting device according to claim 7, characterized in that the processing means enable pre-processing of a concatenated image by averaging and/or by autocorrelation of the image.

23. The counting device according to claim 10, characterized in that the processing means enable pre-processing of a concatenated image by averaging and/or by autocorrelation of the image.

24. The counting device according to claim 13, characterized in that the processing means enable pre-processing of a concatenated image by averaging and/or by autocorrelation of the image.

25. The counting device according to claim 17, characterized in that the processing means enable pre-processing of a concatenated image by averaging and/or by autocorrelation of the image.

* * * * *